US007204291B2

(12) United States Patent
Last

(10) Patent No.: US 7,204,291 B2
(45) Date of Patent: Apr. 17, 2007

(54) MODULAR LID AND ACTUATOR FOR UNDERWATER POOL COVER DRUM ENCLOSURE

(76) Inventor: Harry J. Last, 1010 Koohoo Pl., Kailua, HI (US) 96734

( * ) Notice: Subject to any disclaimer, the term of this patent is extended or adjusted under 35 U.S.C. 154(b) by 0 days.

(21) Appl. No.: 10/758,149

(22) Filed: Jan. 14, 2004

(65) Prior Publication Data

US 2004/0149397 A1 Aug. 5, 2004

Related U.S. Application Data

(63) Continuation-in-part of application No. 09/829,801, filed on Apr. 10, 2001, now Pat. No. 6,827,120.

(60) Provisional application No. 60/440,667, filed on Jan. 15, 2003.

(51) Int. Cl.
*E06B 9/17* (2006.01)

(52) U.S. Cl. ..... 160/23.1; 160/133; 49/21; 74/53; 74/25; 74/625; 4/502

(58) Field of Classification Search ..... 160/133, 160/23.1; 49/21, 340; 52/169.7, 584.1; 74/53, 625, 25; 220/810, 218, 264; 4/502, 4/498, 508, 501
See application file for complete search history.

(56) References Cited

U.S. PATENT DOCUMENTS

| | | | | |
|---|---|---|---|---|
| 1,323,424 | A * | 12/1919 | Towl et al. | 114/119 |
| 2,885,906 | A * | 5/1959 | Cupedo | 74/625 |
| 3,613,126 | A * | 10/1971 | Granderath | 4/502 |
| 4,411,031 | A | 10/1983 | Stolar | |
| 4,416,085 | A * | 11/1983 | Lybecker et al. | 49/340 |
| 4,577,352 | A | 3/1986 | Gautheron | |
| 4,838,403 | A * | 6/1989 | Layer | 192/141 |
| RE33,201 | E * | 4/1990 | Dickinson | 404/6 |
| 5,184,357 | A | 2/1993 | Last | |
| 5,351,440 | A * | 10/1994 | Vincent | 49/340 |

(Continued)

FOREIGN PATENT DOCUMENTS

| | | | |
|---|---|---|---|
| DE | 3032277 | A1 | 7/1982 |

(Continued)

*Primary Examiner*—Blair M. Johnson
(74) *Attorney, Agent, or Firm*—David E. Newhouse, Esq.; Ray K. Shahani, Esq.

(57) ABSTRACT

The present invention is a modular lid system for an underwater swimming pool cover or other underwater enclosure. The modular lid has a rigid lid portion which has an overall buoyancy such that the lid portion closes the enclosure underwater by force of gravity. The modular lid system also has a remote power pack for providing a source of hydraulic power to the modular lid. The remote power pack is located at a position remote from the swimming pool. The remote power pack includes a hydraulic pump and a hydraulic drive mechanism is actuated by the remote power pack. The drive mechanism has a predetermined range of movement. A decoupled linkage mechanism extends between the hydraulic drive mechanism and the lid portion for causing limited opening movement thereof. The limited opening movement corresponds to the predetermined range of movement of the hydraulic drive mechanism. Thus, the decoupled linkage mechanism disengages from the lid portion during closing movement of the linkage mechanism and allows for manual opening movement of the lid portion beyond the limited opening movement caused by the linkage mechanism for increased access to the underwater enclosure.

6 Claims, 10 Drawing Sheets

U.S. PATENT DOCUMENTS

| | | | | |
|---|---|---|---|---|
| 5,546,751 | A | 8/1996 | Last | |
| 6,446,276 | B2 * | 9/2002 | Mathis | 4/502 |
| 6,536,175 | B2 * | 3/2003 | Conterno | 52/489.1 |
| 6,827,120 | B2 * | 12/2004 | Last | 160/133 |
| 2001/0034905 | A1 * | 11/2001 | Mathis | 4/502 |
| 2002/0092853 | A1 * | 7/2002 | Wang | 220/263 |
| 2003/0084502 | A1 * | 5/2003 | Epple et al. | 4/502 |

FOREIGN PATENT DOCUMENTS

| | | | |
|---|---|---|---|
| DE | 19807576 | A1 | 10/1998 |

* cited by examiner

602

MODULAR LID AND ACTUATOR FOR UNDERWATER POOL COVER DRUM ENCLOSURE

RELATED APPLICATION

This Application is a Continuation-In-Part utility patent application related to U.S. patent application Ser. No. 09/829,801, filed Apr. 10, 2001, now U.S. Pat. No. 6,827,120, entitled AUTOMATIC POOL COVER SYSTEM USING BUOYANT-SLAT POOL COVERS, which is incorporated herein by reference in its entirety, and claims any and all benefits to which it is entitled therefrom. This Application is also related to U.S. Provisional Patent Application Ser. No. 60/440,667 filed Jan. 15, 2003 entitled APPARATUS AND METHOD FOR OPENING AND CLOSING A POOL COVER DRIVE CHAMBER, which is incorporated herein by reference in its entirety, and claims any and all benefits to which it is entitled therefrom. This Application is also related to U.S. Provisional Patent Application Ser. No. 60/517,246 filed Nov. 4, 2003 entitled CONCEALED HINGE CONSTRUCTION FOR MODULAR LIDS TO COVER SUBMERGED IN-FLOOR OR INWALL COVER RECESSES, which is incorporated herein by reference in its entirety, and claims any and all benefits to which it is entitled therefrom.

FIELD OF THE INVENTION

The present invention relates generally to automatic swimming pool cover systems, and more particularly, to a modular lid system having a hydraulic or pneumatic cylinder actuator for an underwater pool cover drum enclosure.

BACKGROUND OF THE INVENTION

Automatic pool cover systems utilizing interconnected rigid buoyant slats, which roll up on a submerged or elevated drum as described by U.S. Pat. No. 3,613,126, to R. Granderath, are popular in Europe. These pool cover systems utilize passive forces arising from buoyancy or gravity for propelling, the cover to extend the cover across a pool. With either buoyancy or gravity, there must be some mechanism to prevent a retracted cover from unwinding responsive to the passive force. Such passive force systems also have a disadvantage in that the passive force must be overcome during retraction. Granderath suggests a worm gear drive mechanism for winding the cover and preventing cover drum rotation when not powered. The slats for these are further described in U.S. Pat. No. 4,577,352, to Gautheron.

U.S. Pat. No. 4,411,031 to Stolar describes a system similar to Granderath where instead of rigid hinged buoyant slats, various floating sheet materials such as a polyethylene polybubble, or a laminate of vinyl sheeting and foamed substrate, are floated on the surface of the water. The propulsion of the cover across the pool is reliant on buoyant and gravitational forces much like the system in the Granderath patent.

Pool covers which employ floating slats or similar materials, and which use buoyant forces to propel the cover across the pool, necessarily wind the cover onto a roller drum which is positioned above or below the water surface. In the case of covers wound onto a spool sitting above the edge of the pool, such as at one end or another, when the cover is fully wound onto the cover drum, the entire rolled up cover sits above the surface of the edge of the pool. In some cases, the cover and drum are located in a separate bench apparatus setting next to the pool. The design is to aesthetically hide the cover and roller drum and also allow the entire mechanism to be manually rolled backwards away from the end of the swimming pool.

Using a separated gear drive system with limit switches to travel such a limited distance is costly and it complicates timing of the two drive systems. Furthermore, these electric drives require the supply of electrical current right next to the swimming pool which poses the possibility of a shock safety hazard. Moreover, having the electrical apparatus near the pool accelerates corrosion of the electrical components, rendering them unreliable, as well as exposing the components to flooding and costly repair.

In many known European application of such hinged lid recess systems, the manual or automatic hinged lid is shortened or made somewhat narrower, so as to partially close the recess and leave a gap or aperture sufficient to allow the slatted cover to pass through. Typically the leading edge portion of the cover is not fully retracted beneath the lid, but left remaining partly above it, so as to permit the cover to lead properly through the aperture on the covering mode of travel, i.e., during putting on the pool cover. This is important because if the leading edge of the cover was not fed properly through the aperture and jammed there, the cover drive system, which would continue to unwind, would cause the cover slats to jam and damage underneath the lid.

Typical lid systems for underwater cover drum enclosures, which incorporate an aperture or opening for cover slates to pass through, are unattractive and also create a potential safety hazard. If a swimmer steps into the aperture and is trapped, injury and even drowning can result. Consequently, most American Health and Safety inspectors do not allow such aperture design in public and commercial pools, or even some residential pools.

Another problem with slatted cover systems, which emerge from beneath the pool floor or the pool side wall or generally below the water surface, is the difficulty maintaining correct slat orientation. The cover slats move vertically upward by buoyancy at the beginning of the cycle, break the water surface, and subsequently change direction to travel in a floating horizontal direction. Often difficulties arise in assuming and maintaining correct orientation. This is often solved by having the leading slat component section prebent or fixed in an orientation towards the desired direction of travel. Often this is not sufficient when the cover drum is one foot or more below the water surface and the cover will often sway back and forth below the water, making direction of travel upon breaking the surface of the water unpredictable. Another possible solution is to slow down the speed of emergence of the slatted cover during the unwinding cycle to gain sufficient control until the slats break the water surface, but results are still unpredictable absent a tracking or guide system to guide the leading edge of the cover in the desired direction.

German Patent DE 3032277 A1 to R. Granderath describes a pool floor lid covering system in which an air bladder induction system is introduced to open the lid prior to allowing the cover to unwind from the cover windup roller, and to close when the cover is fully retracted. German Patent DE 198 07576 A1 to Frey describes yet another mechanism to cover the pool cover roller mechanism located in the floor of the swimming pool wherein a floating door is moved vertically to the water surface by cables that are wound up on reels from the pool cover cavity in the floor. The system utilizes a worm gear reducer drive, similar to that used to drive the pool cover drum, to actuate the door closing system. This system is generally well known. Typically, the covering hinged lid system is actuated by means of a separate worm gear reducer drive powered by an electric motor and connected to the hinged lid shaft. Electric-mechanical limit switches devices are used to stop the rotary drives which subsequently engage and power the floating lid reels and the hinged lids, at the proper point of rotation.

Hinged lids would normally only have to rotate 40 to 60 degrees to create a sufficient aperture for the slatted cover to pass through on its way from beneath the pool floor to the water surface. Using a separated gear drive system with limit switches to travel such a limited distance is costly and it complicates timing of the two drive systems. Furthermore, these electric drives require the supply of electrical current right next to the swimming pool which poses the possibility of a shock safety hazard. Moreover, having the electrical apparatus near the pool accelerates corrosion of the electrical components, rendering them unreliable, as well as exposing the components to flooding and costly repair.

Another problem with powered floor lid systems is a safety hazard inherent in other types of automatic closing doors. The lid or closure device can potentially crush a swimmers limb that is inadvertently caught between the pool edge and the lid during the closing cycle of the lid or the closing device. For this reason, it is heretofore undesirable to utilize automatic doors or lids on underwater pool cover drum enclosures.

A problem with shaft operated in-floor or in-wall lid systems is that the speed at which the lid is operated can substantially increase structural requirements of the lid system. This is a particularly important consideration at the high torque starting point of the opening cycle when the lid is raised, i.e., rotated about a hinge from a horizontal to the vertical open position.

Another problem is that lid systems which require openings or apertures for allowing the lid to be delivered from the pool floor or an underwater bench design, need only be a gap of 6–12 inches wide, i.e., an opening rotation of the lid of approximately only between about 40–60 degrees. To service the system, however, full access below the lid is required. An opening of at least 24 inches, or enough to allow a person possibly in divers gear, to pass through safely, would be required. The lid may even have to be hinged in a way to rotate a full 90 degrees or more.

Although it would be possible to incorporate current sensing devices or other means to stop the cover when encountering resistence, it is very difficult to set an accurate and workable set point since the torque applied to the lid actuator shaft varies greatly as it passes from a maximum at the horizontal position, through to zero torque at the 90 degree or vertical lid position.

Known manual or automatic lid systems provided by European manufacturers are typically made of lightweight plastic construction, and have a single, unitary integral design. Such lids are typically unattractive and it is difficult to adhere plaster or tile to these plastic components to give the lid the same look or design as the rest of the pool. Furthermore, these lid systems usually employ a single heavy stainless steel shaft running the full width of the pool which has to be of sufficient diameter to be able to transmit torque yet prevent radial deflection of the shaft at the attachment of the furthermost portion of the lid away from the actuator, in order to prevent drooping of the lid.

A problem with shaft operated on-floor or in-wall lid systems is that the speed at which the lid is operated can substantially impact and add to structural requirements of the lid system. This is particularly so at the high torque starting point of the opening cycle when the lid is raised or rotated about the hinge from a horizontal to the vertical open position.

As described in several other applications and patents by the inventor, automatic cover drive systems have to be mounted next to the swimming pool and frequently below the pool deck surface. With the exception of hydraulic drive systems as described in the inventor's prior U.S. patent and applications, most floating and slatted cover systems use electric drive systems. This creates a potential shock hazard near the pool surface area and furthermore, when these systems are even briefly submerged, or flooded, expensive damage and repair costs are often required.

The inventor's previous U.S. Pat. No. 5,184,357 entitled AUTOMATIC SWIMMING POOL COVER WITH A DUAL HYDRAULIC DRIVE SYSTEM, and inventor's U.S. Pat. No. 5,546,751 entitled ANTI-CAVITATION MANIFOLD FOR DRIVE COUPLED, DUAL MOTOR, REVERSIBLE HYDRAULIC DRIVE SYSTEMS, are both incorporated herein in their entireties.

ADVANTAGES AND SUMMARY OF THE INVENTION

The present invention comprises a hydraulic or pneumatic cylinder actuator to the auxiliary lid cover mechanisms powered by means of a single physically remote power pack or electric fluid pump. The complete system hydraulics near the pool are supplied with only two hydraulic interchangeable supply and return lines to the physically remote power pack or electric fluid pump.

The proposed invention incorporates a standard hydraulic or pneumatic cylinder, where the full travel of the cylinder is sized to the arc of travel of the lever arm acting to move the pool floor lid system from the closed to the operational open position and uses the mechanical end travel of the cylinder and the consequent pressure surge to actuate a pressure switch and/or various sequencing valve means to actuate other components of the system in a timed and sequenced and velocity controlled manner.

It is an object and advantage of the present invention to provide a pool cover system in which the cover is rolled up on a spool or cover drum in an enclosed structure sitting on the floor of the pool, or enclosed within a pit underneath the surface of the pool.

A distinct advantage of the hydraulic or pneumatic cylinder means is that the end stop actuation or travel limiting means is now accomplished by utilizing the immediate fluid pressure surge or increase as the cylinder reaches its mechanical end of travel, and combining or utilizing this with a remote electro-hydraulic pressure switch at the remote power pack to either stop the power pack pump, or by means of a sequencing valve or a combination thereof, to advance to subsequent step in the pool cover operation and final operation of the steps needed to operate the complete system.

Another advantage of using a hydraulic or pneumatic actuator is the speed of the cylinder and consequently the linear velocity of the lid operation can be easily and simply controlled by a pressure valve and by timed fluid flow diversion, all using components that are not affected by moisture or compromising the safety of swimmers with a potential electric shock hazard.

Another advantage of using hydraulics or air means is that the speed of the cover drive tube can be easily temporarily slowed by using a valve connected to, and actuated through a timing device to bleed off part of the flow to die reservoir or tank, thereby slowing the cover drive tube, and hence, the overall speed of the moving bench enclosure.

It is yet another object and advantage of the present invention to provide a pool cover system in which the lid is modular, thereby eliminating the problems associated with buoyancy and torque along an elongated single-section pivot point hinge by providing a modular lid system, each individual modular panel element can be adjusted accurately so as to provide a lid system which has a predetermined buoyancy at one end and another, predetermined buoyancy at the other end, along with a drive gear located only at one end. Thus, in the present invention, by applying a torque at one end only, the rigid modular lid system will open along its entire length, in a uniform manner, eliminating lid droop at the far end as well as compensating for buoyancy of the lid along its entire length.

DETAILED DESCRIPTION OF THE PREFERRED EMBODIMENT

Figure 1A:
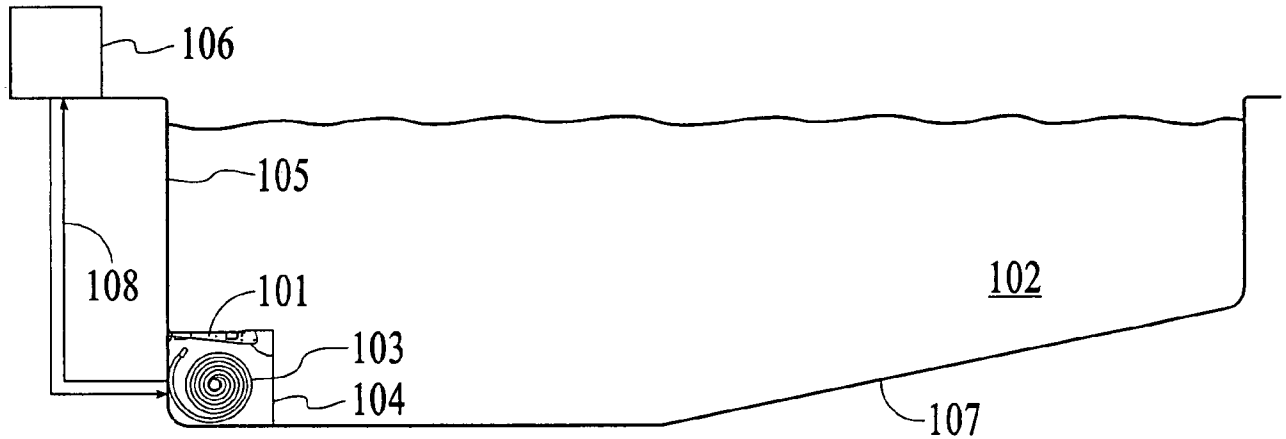
FIG. 1A is a representative section view showing the modular lid 101 of a cover drum enclosure system 104 of the present invention and method of use thereof.

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

It will be understood that in the event parts of different embodiments have similar functions or uses, they may have been given similar or identical reference numerals and descriptions. It will be understood that such duplication of reference numerals is intended solely for efficiency and ease of understanding the present invention, and are not to be construed as limiting in any way, or as implying that the various embodiments themselves are identical.

FIG. 1A is a representative section view showing the modular lid 101 of a cover drum enclosure system 104 of the present invention and method of use thereof. The cover drum enclosure 104 is located on the floor 107 and against the wall 105 of the swimming pool 102.

The modular lid 101 is shown in the closed position, with the floating or other type of pool cover 103 wound into a roll, completely inside the automatic bench enclosure system 104. It will be understood that any type of pool cover 103 conventionally used or custom made can be used with the underwater pool cover system. However, principally these types of pool covers 103 are floating and may support an object or person standing on top of the closed cover. It will further be understood that such cover systems may include side tracks, grooves, anti-biasing or auto-aligning mechanisms for any of a variety of purposes, including but not limited to keeping the sides of the cover in a track or oriented in the proper direction, etc.

Figure 1B:
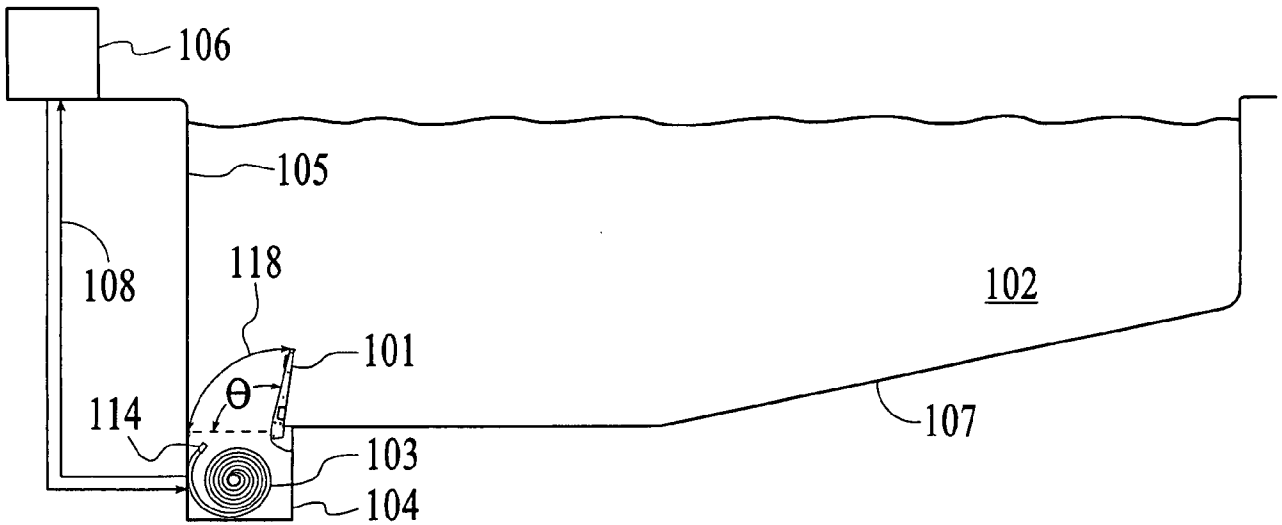
FIG. 1B is a representative section view showing the modular lid 101 of a cover drum enclosure system 104 of the present invention and method of use thereof.

FIG. 1B is a representative section view showing the modular lid 101 of a cover drum enclosure system 104 of the present invention and method of use thereof. The cover drum enclosure 104 is imbedded in the floor 107 of the swimming pool 102.

In this view, the modular lid 101 is in a partially open position, as shown, and the combination floating cover system 103 is slightly unwound and starts to float outside the automatic bench enclosure system 104 through the opening 118. In this view, it will be understood that the lid 101 is open at an angle θ, which operatively would be between about 40 degrees to about 60 degrees.

Figure 1C:
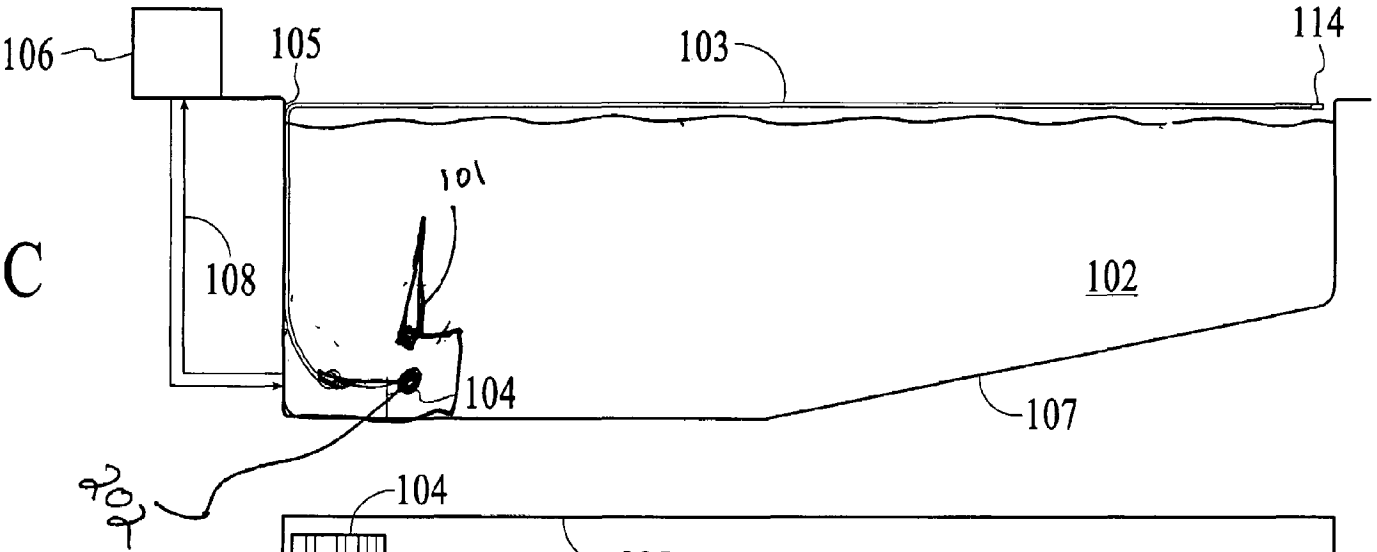
FIG. 1C is a representative section view of the modular lid 101 of a cover drum enclosure system 104 of the present invention in a partially open position with pool cover 114 in the extended position.

FIG. 1C is a representative section view of the modular lid 101 of a cover drum enclosure system 104 of the present invention in a partially open position with pool cover 103 in the extended position. The cover drum enclosure system 104 is on the floor 107 and against the wall 105 of the swimming pool 102 as shown in FIG. 1A.

In this view, the modular lid 101 is in an open position and pool cover 103 is in the extended position. As shown, floating pool cover 103 lies on top of the surface of the water 114 across the entire swimming pool 102.

It will be understood that the modular lid 101 should open to a sufficiently higher angle so as to not rub excessively on the pool cover 103 as it winds or unwinds on the cover drum 202. furthermore, in general, the systems 104 are designed such that the fully unwound cover drum 202 is directly below the plane defined by the fully open lid cover 101.

Figure 1D:
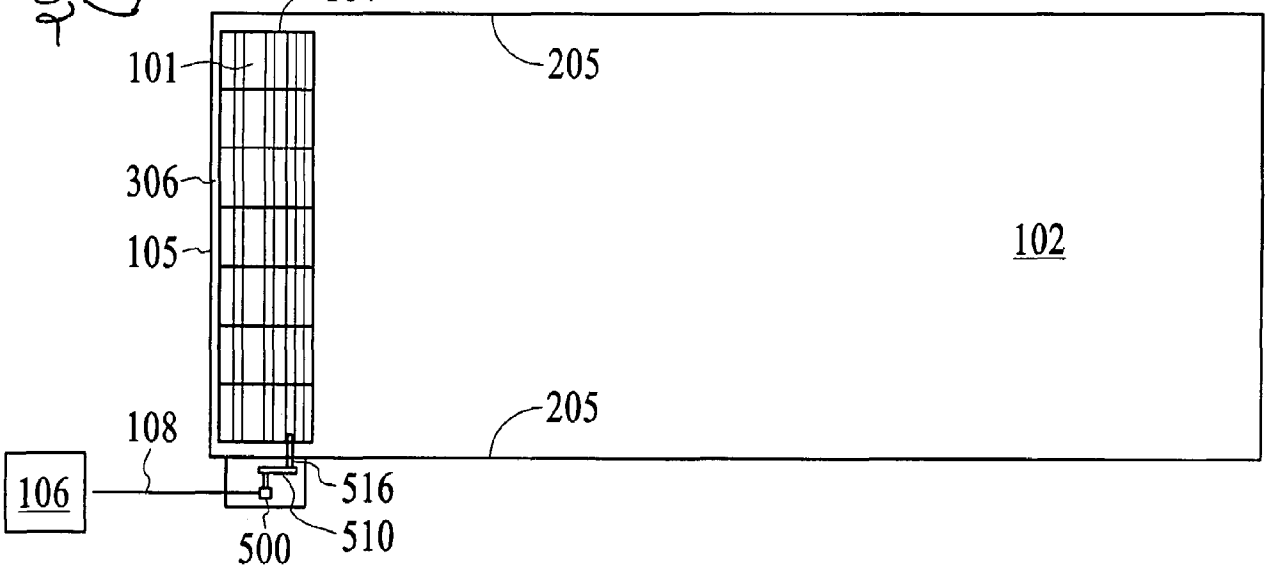
FIG. 1D is a representative plan view of the modular lid 101 of a cover drum enclosure system 104 of the present invention.

FIG. 1D is a representative plan view of the modular lid 101 of a cover drum enclosure system 104 of the present invention. As best shown in FIGS. 1A–1D, automatic pool cover enclosure system 104 is powered by a physically remote power pack pump 106 that supplies the complete system hydraulics via a two hydraulic interchangeable supply and return lines 108.

It will be understood that while the hydraulic lines 108 are shown as single or double lines, in many cases it is desirable to use 4 or more hydraulic lines, additional actuators and/or a hydraulic fluid manifold. Such modifications in hydraulic line configuration and actuator control will be known to those skilled in the art.

Figure 2A:
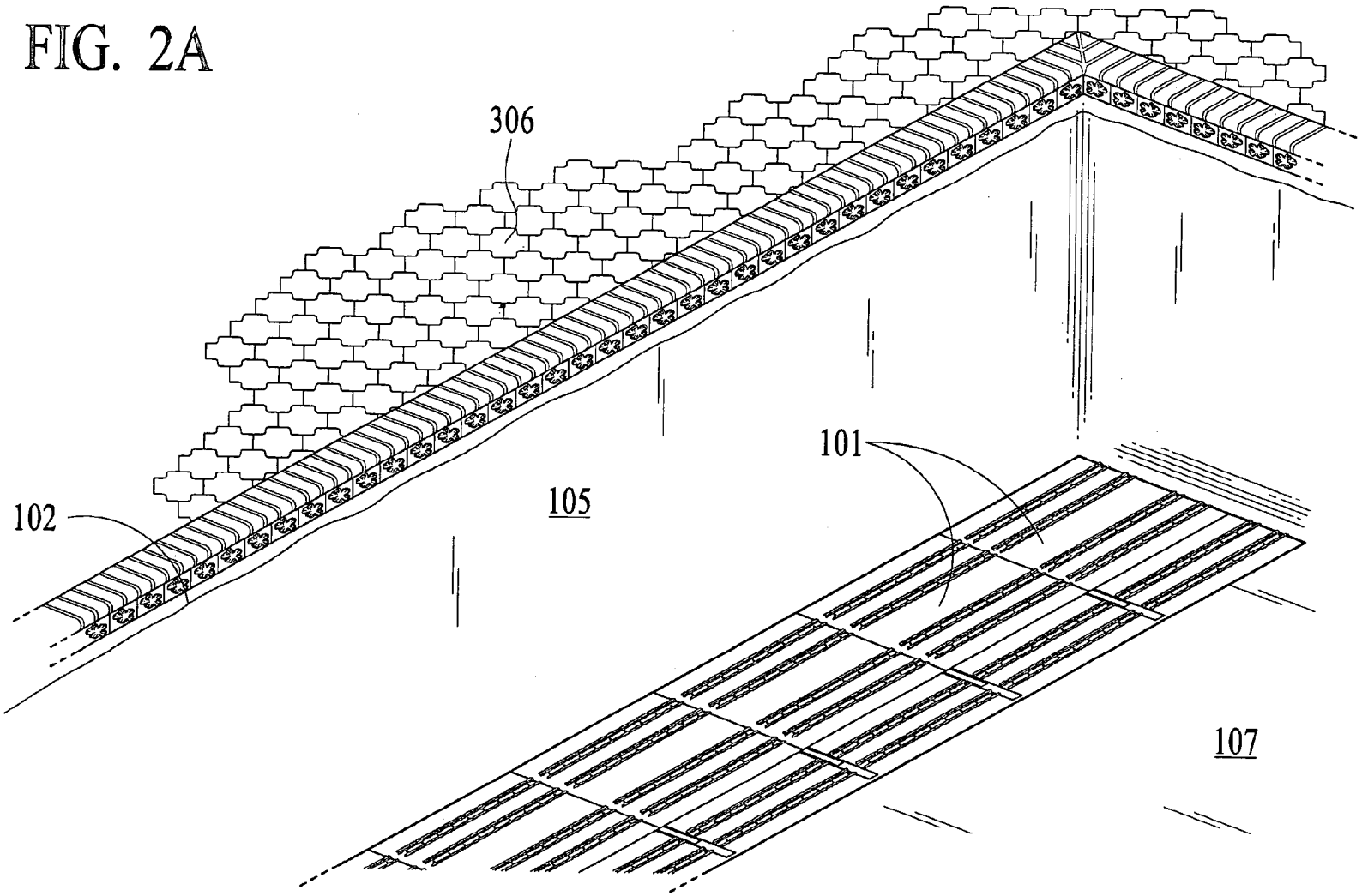
FIG. 2A is a representative perspective view showing the modular lid 101 located in the floor of the swimming pool 102 in the closed position.

FIG. 2A is a representative perspective view showing the modular lid 101 located in the floor of the swimming pool 102 in the closed position. As shown, the system 104 is imbedded in the floor 107 and against the wall 105 of the swimming pool 102.

Figure 2B:
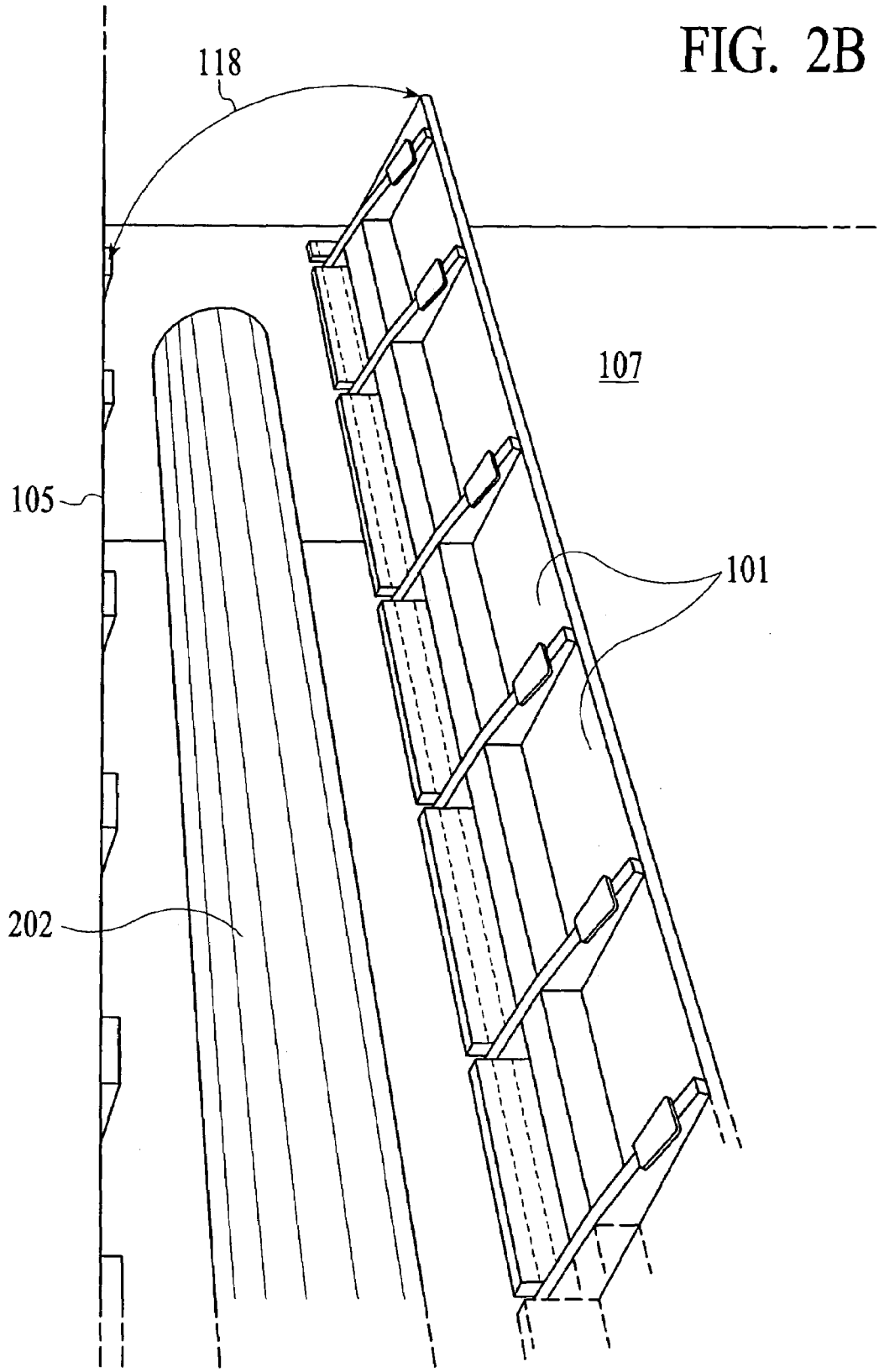
FIG. 2B is a representative perspective view showing the modular lid 101 located in the floor of the swimming pool 102 in the open position.

FIG. 2B is a representative perspective view showing the modular lid 101 located in the floor of the swimming pool 102 in the open position. Lid 101 is in the open position, creating opening 118 that allows the entrance and exit of cover 103. As shown, the enclosure system 104 is imbedded in the floor 107 and against the wall 105 of the swimming pool 102. Inside the bench system 104, there is pool cover 103 cover drum 202. It will be understood that the lid 101 can be fully opened into a serviceable, open position when needed.

Figure 3:
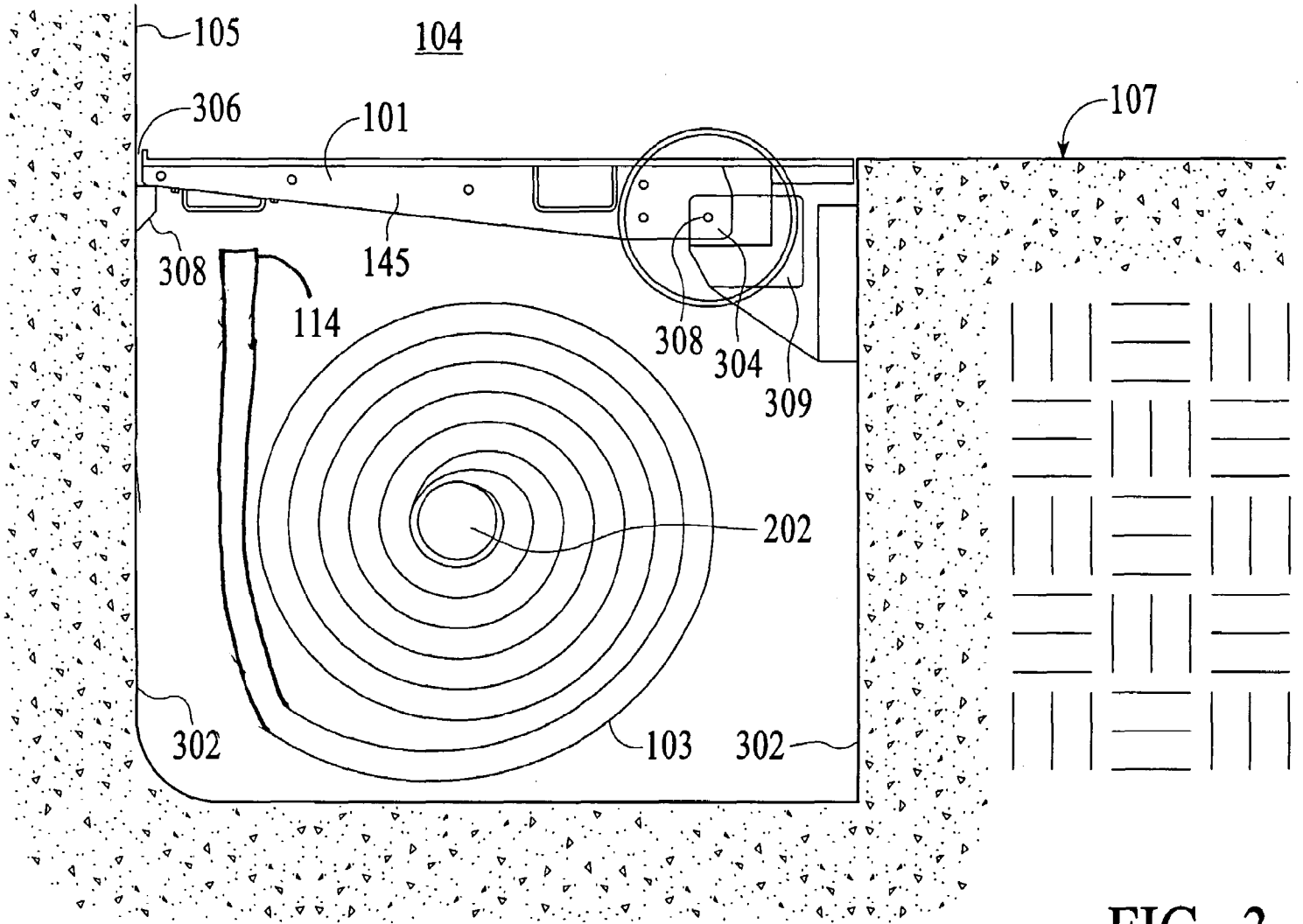
FIG. 3 is a representative cross section view showing the modular lid 101 of a cover drum enclosure system 104 and the cover drum 202.

FIG. 3 is a representative cross section view showing the modular lid 101 of a cover drum enclosure system 104 and the cover drum 202. In the preferred embodiment, the cover 103 is housed within pool cover recess walls 302 on either side. As shown, floating cover system 103 is wound around cover drum 202. The floating lead portion 114 of cover 103, as a result of buoyance, starts to unwind the cover 103 and will lead the way for the rest of the cover 103 to float or be drawn upward, through the lid opening 118, and outside the entire enclosure system 104.

It will be understood that the floating leading edge 114 of the pool cover 103 is optional, and often not necessary or desirable in floating slat as well as polybubble and other cover systems. It will also be understood that cover pit or enclosure 114 need not be excessively large, and in certain circumstances excessively large pit or enclosure 114 may result in premature or unintended unwinding, basically due to excessive floatation on one side or the other side and inadequate, non-uniform pool cover wrap.

In the preferred embodiment, distance between the two pool cover recess walls 302 should be larger than the diameter of the floating cover 103 to allow room for unwinding. Cover lid 101 is secured at the hinge point 308 for opening of the lid 101 to hinge plate 309 and spacers 304 with shoulder bolts. As shown in FIG. 3, lid 101 is in a closed position. In the preferred embodiment, lid 101 does not cover the entire gap, but rather rests on stopper element 308, leaving an approximately one-inch buffering space 306 clearance with pool cover recess wall 302.

Figure 4A:
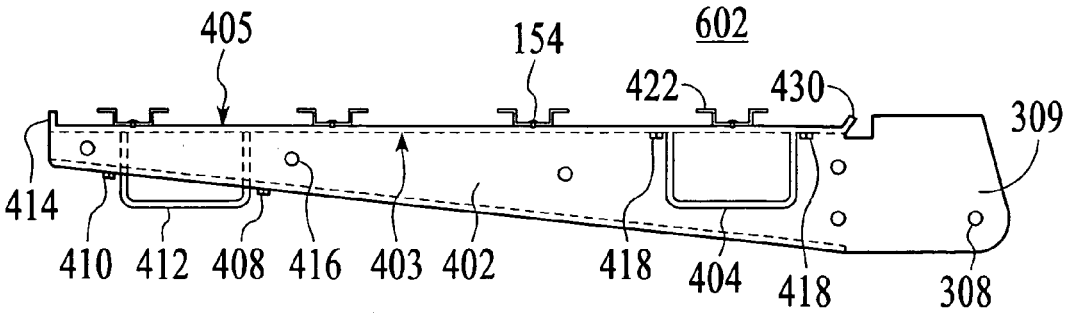
FIG. 4A is a representative cross section view of a modular lid section 602.

FIG. 4A is a representative cross section view of a modular lid section 602. In a preferred embodiment, torsion structural member 404 of tubular box material form or construction is either welded or fastened to the underside surface 403 of lid section 602. Moreover, buoyancy tank 412 is attached to the lid section 602 at optionally hinged elements 408. As described, the main function of these buoyancy tanks is to counterbalance the weight of the overall modular lid 101 such that a minimum amount of torque provided at one end will effect opening of the entire modular lid 101 without the effect of end droop. Thus, the buoyancy tanks 412 of individual lid sections 602 will be individually designed or adjusted so that the buoyancy desired at the far end of the modular lid system 101 as well as at the near end of the modular lid system 101 will be achieved.

It will be understood that in preferred embodiments, the buoyancy tank 412 can be omitted entirely, i.e., it is optional. In many cases, the buoyancy tank 412 will be unnecessary due to inherent buoyancy of the modular lid sections 602 or entire assembly 101.

Also shown in FIG. 4A are the novel structural mortar retainer clips 422 that are fastened to the top surface 405 of lid section 602 with screws 154. The main function of the hat shaped clips 422 is to enhance the bonding of the pool surface matter such as stucco finish or tile grout to the top surface 405 of lid section 602. In the preferred embodiment, each row of structural mortar retainer clips 422 runs the entire length of lid section 602. Individual rows are arranged in a way that adequate spacing is allowed between them. The plurality of grout retaining clips 422 provide the additional functionality of enhancing structural rigidity, integrity and support in the longitudinal direction of the lid sections 602. It also enhances the adhesion of mortar or plaster materials to the stainless steel surface of lid 101.

Also shown in FIG. 4A is hinge point 308 for opening the lid 101. The lid section 602 is secured to the hinge plate 309 and spacers 304 with shoulder bolts, and pivots about cover lid axis at hinge point 308.

Figure 4B:
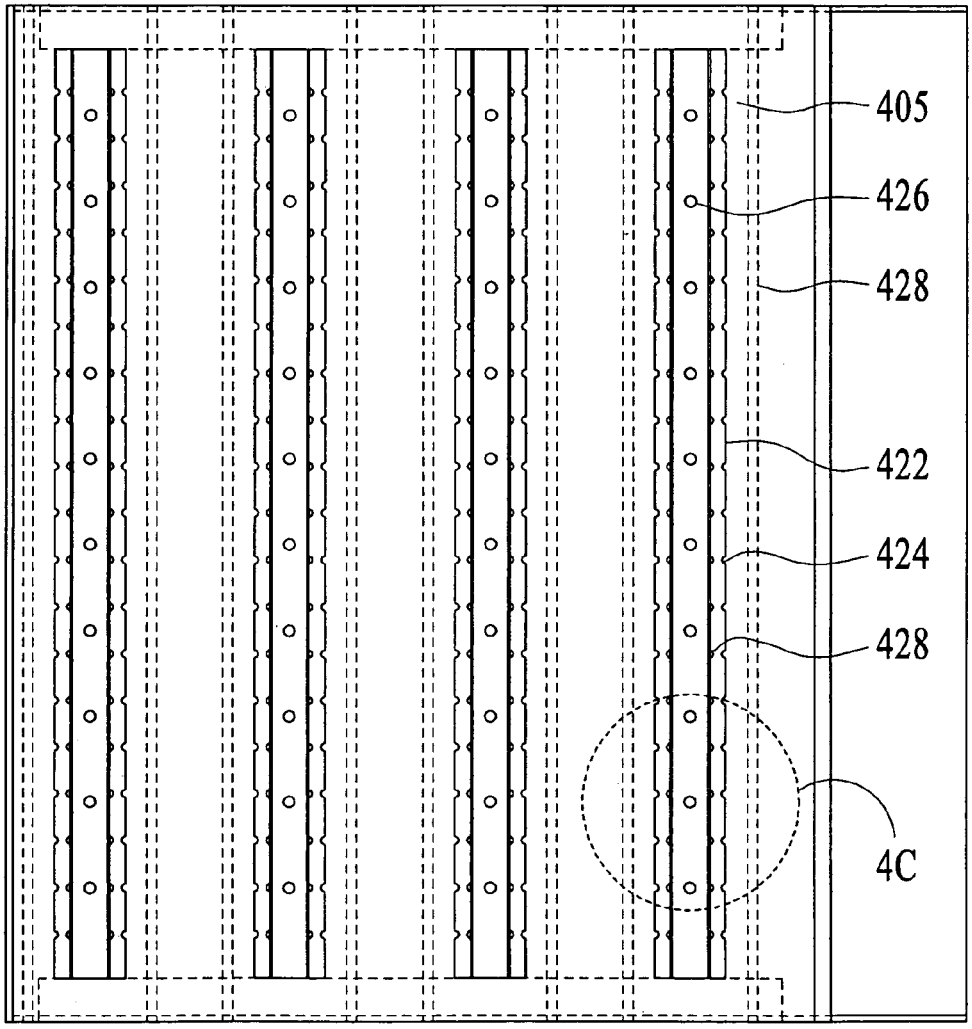
FIG. 4B is a representative top view of a modular lid section 602.
Figure 4C:
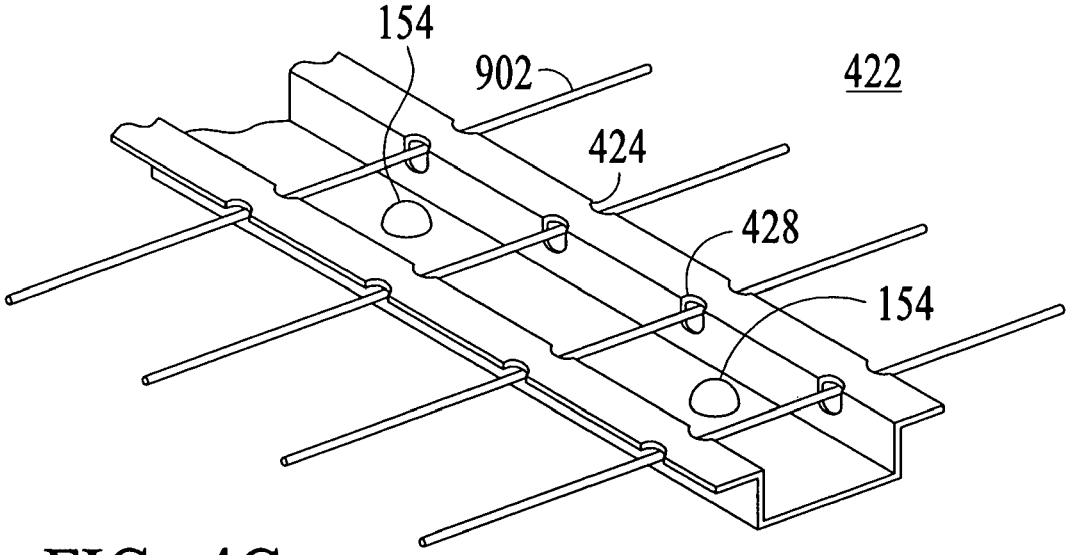
FIG. 4C is a detail view of the structural mortar retainer clip 422.

FIG. 4B is a representative top view of a modular lid section 602. FIG. 4C is a detail view of the structural mortar retainer clip structure 422. As shown, the structural mortar retainer clips 422 are fastened to the top surface of lid 101 with screws 154. The main function of clips 422 is to enhance the bonding of the pool surface matter or tile grout to adhere to the surface of modular lid 101. In the preferred embodiment, each row of structural mortar retainer clips runs the entire length of lid 101. Individual rows of clips 422 are arranged such that adequate spacing is allowed between them. These clips 422 enhances the adhesion of mortar or plaster materials to the stainless steel surface of lid 101. Clips 422 have scalloped edge sections 424 running the entire length. There are also openings 428 through the sides of the hat shaped clips 422. This particular arrangement also provides structural integrity and support in the longitudinal direction of the lid sections 101.

Torsion chamber 404 is tack welded at weld spots 426 to the bottom of pan section 601, thus rendering the lid section 602 rigid and non-deforming. Tack welding is preferred to bolting to provide a rigid, non-moveable lid section 602.

Figure 5A:
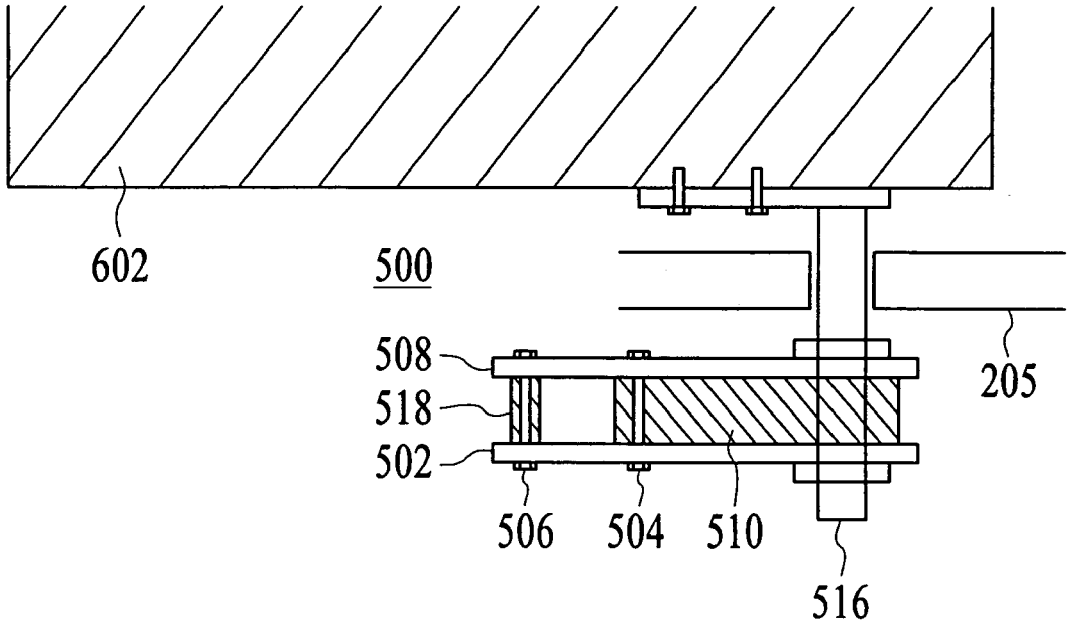
FIG. 5A is a representative top view of a modular lid 101 actuator system 500.
Figure 5B:
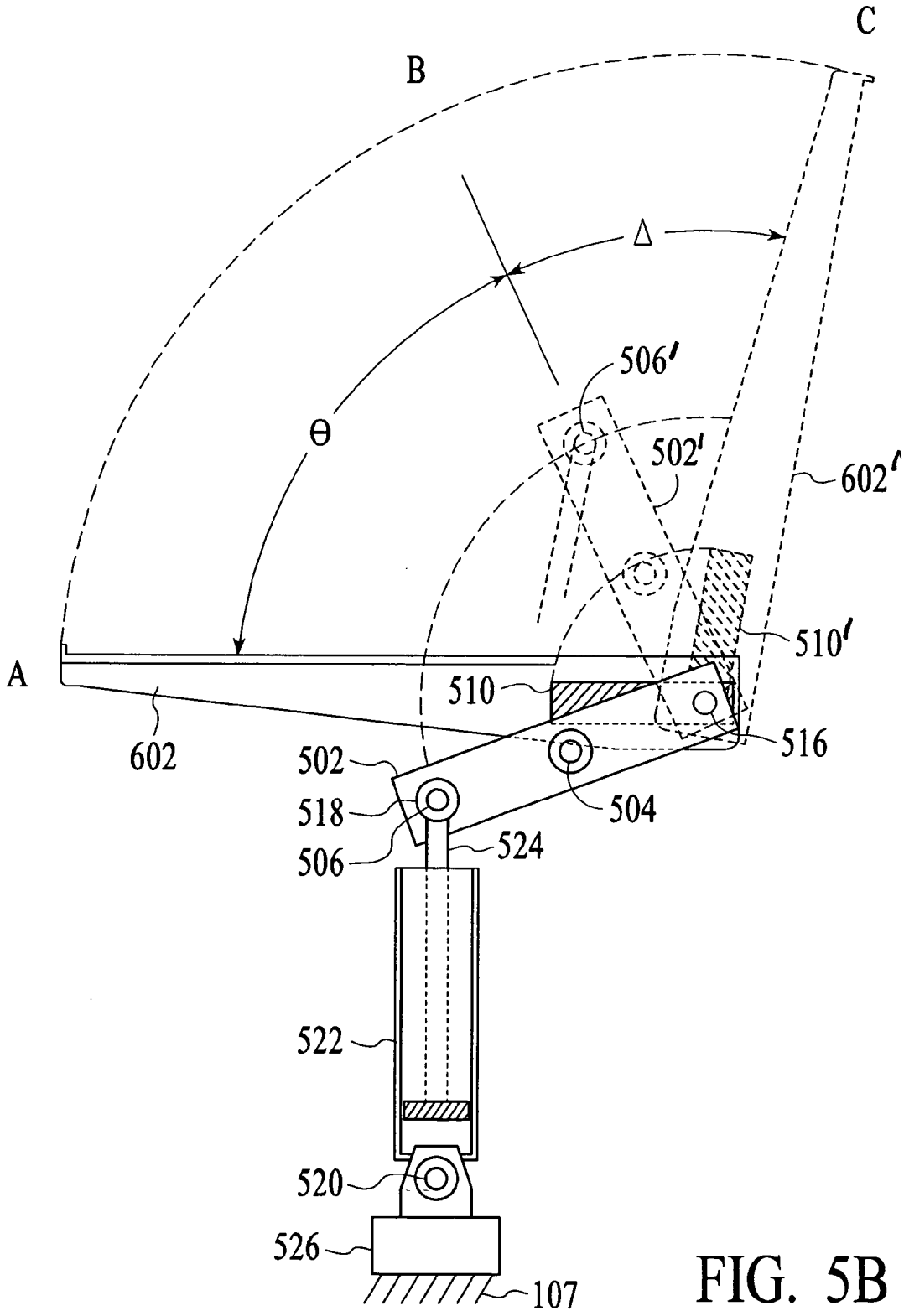
FIG. 5B is a representative top side of a modular lid 101 actuator system 500.

FIG. 5A is a representative top view of a modular lid 101 actuator system 500. FIG. 5B is a representative side view of a modular lid 101 actuator system 500. As shown, an actuator lever block 510 is attached to shaft 516, which is coupled through swimming pool wall 205 to lid panel section 602. In use, the actuator lever block 510 is propelled upward, as shown, in a clockwise direction, through pin 504 which passes through plates 502 and 508 and spacer sleeve 518. Spacer sleeve 518 is essentially a section of tube having a width slightly larger than the width of block 510. This allows block 510 slide and move between the plates 502 and 508. Plates 502 and 508 also are clamped to spacer sleeve 518 by bolt 506. Spacer sleeve 518 passes through the end of the cylinder rod 524 of cylinder 522.

Cylinder 522 is fixed to the pool floor 107 by hinged pin 520 and wall bracket 526. When the rod end 524 of the cylinder 522 extends or moves upwards, such as upon actuation of the modular lid 101, force is transmitted through pin 520 and spacer sleeve 518, and through to the side plates 502 and 508 and pin 504. Subsequently, rod end 524 pushes up against the actuator lever block 510 to lift lid section 602 upwards rotated on shaft 516.

It is also noted that the entire modular lid 101 will move upwards from the position indicated as A to the position indicated as B, or through angle θ of approximately 40–60 degrees. This angle θ is sufficient to create an opening 118 for the cover 103 to pass through. However, since the modular lid 101 is not connected directly to the cylinder 522 but to the shaft 516 and block 510, the lid 101 can continue to move independently, such as manually, through angle Δ to the position indicated as C. Thus, the modular lid 101 can be moved through angle θ as well as through angle Δ to create a greater opening for access if necessary.

It will be understood that opening the modular lid 101 to point B through angle θ can be done with the actuator 500. However, since the modular lid 101 is decoupled from the actuator 500, the lid 101 can be moved manually past point B through angle Δ. This additional movement of the lid 101 can be accomplished with a minimum of force or torque given the counterweighted and balanced set of individual lid sections 602, each optionally having their own buoyancy chamber portion 412.

By providing a lid actuator system which is decoupled from the lid section, i.e., bearing surface on actuator block 510, once the actuator piston 524 is retracted back into cylinder portion 522, the lid 101 will close under the force of gravity alone. As an additional safety measure, therefore, the lid 101 can be manually raised and lowered.

Also as shown, modular lid 101 can be lowered to the closed position A by the force of gravity. This safety feature guarantees that if the modular lid 101 were to meet an obstruction on the way down, such as a swimmer's limb or other obstruction, the cylinder rod 524 along with the attached plates 502 and 508 could continue to close under hydraulic pressure until the cylinder rod end 524 is fully retracted into the cylinder 522. In this design, the modular lid 101 could safely remain in partially open position such as at position B until the obstruction was cleared, at which time the modular lid 101 can then simply sink back down to a closed position A.

Figure 6:
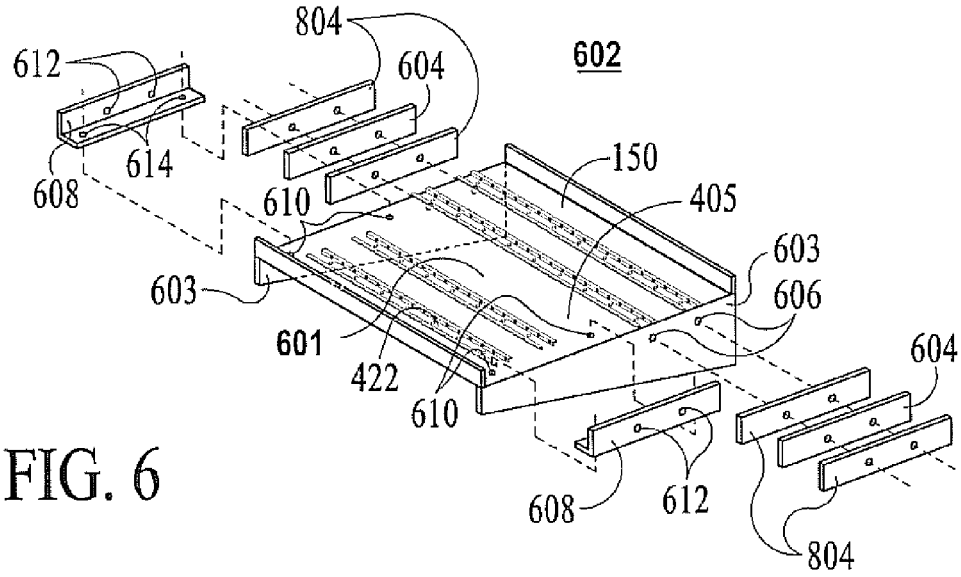
FIG. 6 is a representative perspective view of the base 600 of pan section 601 used in the modular lid section 602.

FIG. 6 is a representative, lower perspective view of the base 600 of pan section 601 used in the modular lid section 602. As shown, structural mortar retainer clips 422 runs the entire length of lid section 602.

Modular lid sections 602 are mechanically jointed together to form a complete cover lid 101 by a plurality of gauge support plates 604 and L-shaped brackets 608. Gauge support plates 604 are inserted at holes or openings 606, which are located on both side panels 603 of each lid section 602. The plates 604 are inserted and bolted between adjacent lid sections 602. The base of L-shaped brackets 608 are secured at holes or openings 610, which are located on both sides of the top surface of lid sections 602. The flaps of L-shaped brackets 608 on adjacent lid sections 602 are bolted together at holes or openings 612. Having gauge support plates 604 and L-shaped brackets 608 alternatively running the entire length of each lid section 602, individual lid sections 602 are then bolted together to form a complete cover lid 101 that runs the full width of the swimming pool 102.

As shown best in FIG. 6, lid pan section 602 has side panels which fold downwards. The side panels are trapezoidal or truncated triangular in shape, and therefore will provide a thicker, structurally stronger section for attaching the torsion bar or torsion chamber 404.

Figure 7:
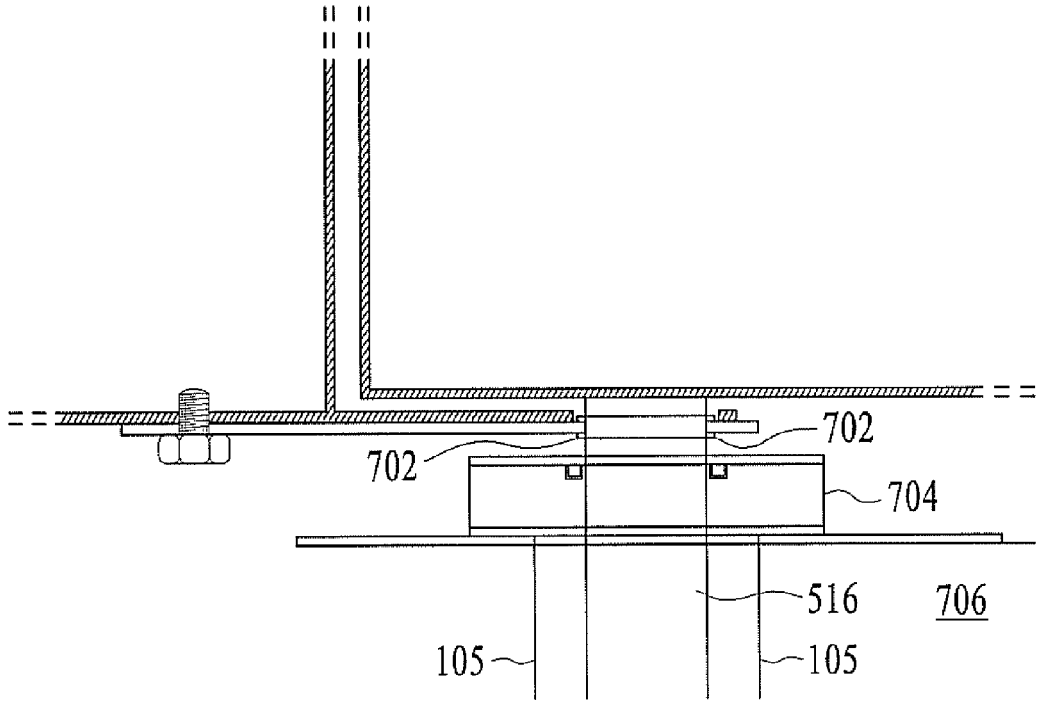
FIG. 7 is a top view of actuator shaft 516 secured to the pool side wall 205.

FIG. 7 is a top view of actuator shaft 516 secured to the pool side wall 205. As shown, the actuator shaft 516 passes through the pool side wall 205 passage section 118 with water seals, for example, a bearing 704 and ring 706 system. The actuator shaft 516 is also connected to the side edge of a modular lid section 101.

Figure 8:
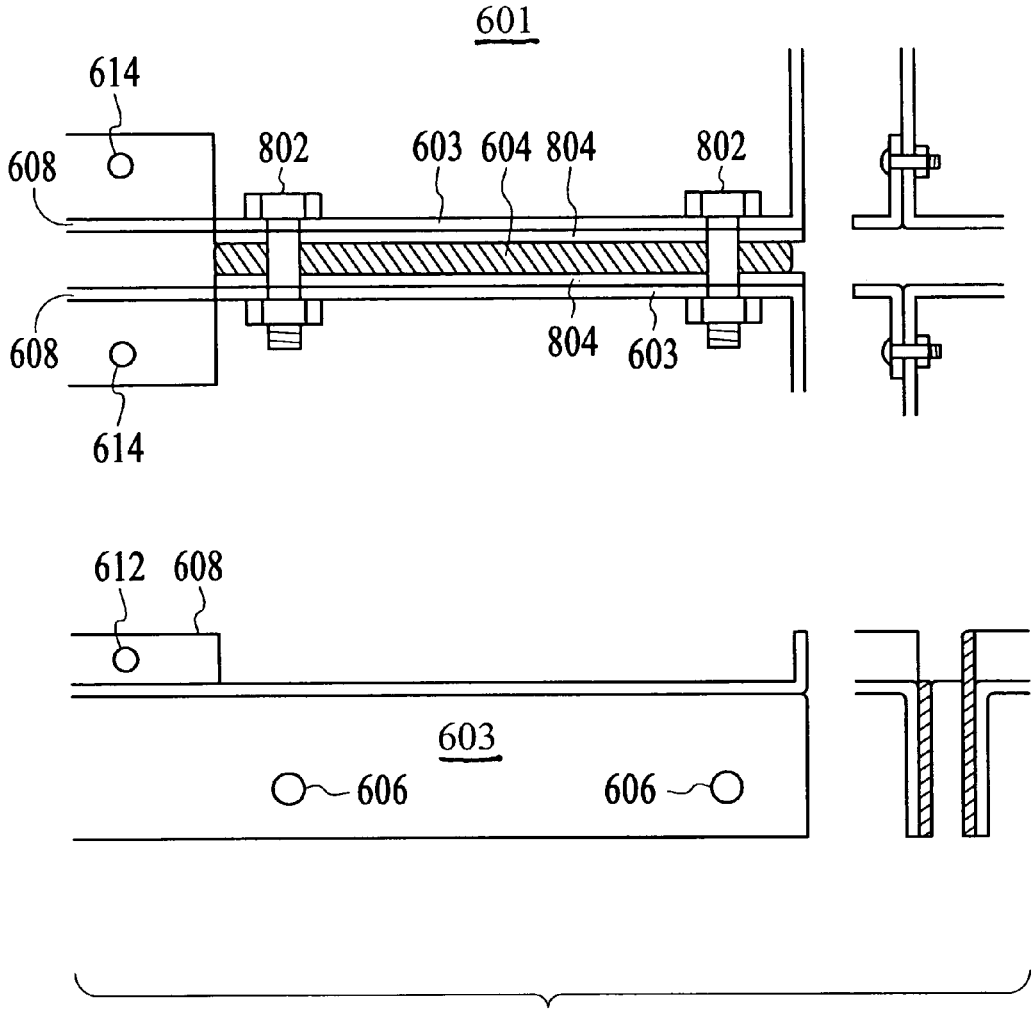
FIG. 8 is a top view of pan sections 601 of the modular lid elements 602 bolted together.

FIG. 8 is a top view of pan sections 601 of the modular lid elements 602 bolted together. As shown, gauge support plate 604 is secured at hole openings 606 by bolts or screws 802. Spacers 804 are inserted on both sides of gauge support plate 604 for cushioning purposes. As best shown in FIG. 6, openings 612 are located on a flap panel of L-shaped brackets 608 and secured onto the top surface of section panel 601 at openings 610. It will be understood that the buoyancy tanks 412 as well as the torsion structural members 404 are bolted or welded into place, having optional tie-rods or long bolts 416 in compressive tension state extending both lengthwise as well as widthwise and between upper and lower surfaces through the modular lid sections 602.

It will be understood that the modular lid 101 of the present invention avoids the use of a central, elongated shaft portion for opening the lid. As opposed to using a shaft portion which may twist and deform based on torsional forces acting thereon, the rigid lid sections 601 bolted together act as a rigid, composite beam or member, impervious to deformation, twisting and one-sided lid droop. the modular lid 101 comprised of individual lid sections 602 will behave similar to a rigid, non-deforming airplane wing. Therefore, the present invention can be shipped to a remote site and installed, without the need for shipping elongated, single reinforced or tapered shaft sections as well as entire lid sections 25 feet long or longer.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. An opening and closing lid system of a compartment disposed underwater in a pool, said system comprising:

a) a remote power pack located at a position remote from the pool for providing hydraulic power;

b) a hydraulic drive mechanism coupled to the remote power pack having an actuator driven by the hydraulic power; and c) a mechanical decoupled linkage extending between the actuator of the hydraulic drive mechanism and a lid of the underwater compartment for allowing hydraulic powered openable as well as manual openable and closeable movement of the lid.

2. A modular lid system on an underwater enclosure located in a pool, the modular lid system comprising:

a) A rigid lid portion having an overall buoyancy such that the lid portion closes the enclosure underwater by force of gravity;

b) A remote power pack for providing a source of hydraulic power to the system, the remote power pack being located at a position remote from the enclosure and including a hydraulic pump;

c) A hydraulic drive mechanism actuated by the hydraulic pump, the drive mechanism having a predetermined range of movement;

d) A decoupled linkage mechanism extending between the hydraulic drive mechanism and the lid portion for causing limited opening movement thereof, said limited opening movement corresponding to the predetermined range of movement of the hydraulic drive mechanism.

3. The modular lid system of claim 2 wherein the rigid lid portion consists of a plurality of modular lid sections coupled together.

4. The modular lid system of claim 3 having L-shaped brackets fastened to side edges of each of the plurality of modular lid sections for securing the modular lid sections together to structurally form a lid closing the underwater enclosure.

5. A lid section for a modular lid covering an underwater enclosure, the lid section comprising:

an inverted pan having an upper surface, an inner surface, 2 opposite side edges, and a leading edge opposite a hinged edge pivotally coupling the lid section to the underwater enclosure;

a torsion structural member disposed adjacent the inner surface and adjacent the hinged edge;

coupling means located on each side edge for coupling the lid section to one or more additional lid sections, whereby the coupled lid sections form a rigid, longitudinal modular lid that can be opened and closed as a unit.

6. The lid section of claim 5, further comprising:

a buoyancy tank disposed adjacent the inner surface and adjacent the leading edge.

* * * * *